United States Patent [19]

Chinnery

[11] Patent Number: 4,598,659

[45] Date of Patent: Jul. 8, 1986

[54] SAILBOARD WITH REMOVABLE FLOATS

[76] Inventor: Lindsay C. Chinnery, 10/16 Maple Grove, Toorak, Victoria, Australia

[21] Appl. No.: 627,994

[22] PCT Filed: Nov. 10, 1983

[86] PCT No.: PCT/AU83/00164

§ 371 Date: Jul. 11, 1984

§ 102(e) Date: Jul. 11, 1984

[87] PCT Pub. No.: WO84/01925

PCT Pub. Date: May 24, 1984

[30] Foreign Application Priority Data

| | | | |
|---|---|---|---|
| Nov. 15, 1982 | [AU] | Australia | PF6804 |
| Nov. 25, 1982 | [AU] | Australia | PF6980 |
| Jul. 27, 1983 | [AU] | Australia | PG0509 |

[51] Int. Cl.[4] ..... B63B 43/14

[52] U.S. Cl. ..... 114/39; 114/123

[58] Field of Search ..... 114/39.1, 39.2, 61, 114/77 R, 77 A, 123, 352, 357; 441/74

[56] References Cited

U.S. PATENT DOCUMENTS

| | | | |
|---|---|---|---|
| 3,572,277 | 3/1971 | Schousboe | 114/77 R |
| 3,916,468 | 11/1975 | Tetreault et al. | 114/352 |
| 4,287,624 | 9/1981 | Lowther | 114/123 |
| 4,303,033 | 12/1981 | King | 114/61 |

FOREIGN PATENT DOCUMENTS

| | | | |
|---|---|---|---|
| 62604 | 9/1980 | Australia | 114/39.2 |
| 26721 | 4/1981 | European Pat. Off. | 114/123 |
| 2852107 | 12/1980 | Fed. Rep. of Germany | 114/39.2 |
| 3013411 | 10/1981 | Fed. Rep. of Germany | 114/39.2 |
| 2462338 | 3/1981 | France | 114/123 |
| 2466390 | 4/1981 | France | 114/39.2 |
| 548336 | 9/1956 | Italy | 114/61 |
| 2058679 | 4/1981 | United Kingdom | 114/123 |
| 2084521 | 4/1982 | United Kingdom | 114/39.2 |

*Primary Examiner*—Trygve M. Blix
*Assistant Examiner*—Stephen P. Avila
*Attorney, Agent, or Firm*—Shlesinger Arkwright Garvey & Fado

[57] ABSTRACT

An accessory for a sailboard (12) comprises a pair of rigid float members (28) which are rigidly mounted to the sailboard (12) to form, with the sailboard a substantially unitary structure, the upper surfaces of the float members (28) constituting an extension of the upper surface of the sailboard (12) on which the sailboard rider can stand.

15 Claims, 12 Drawing Figures

13
14
15
37
13A
28
38
12
17
16
28
24
22

17
28
23
18
21
19
26
24
22
27
29
28

FIG. 6.
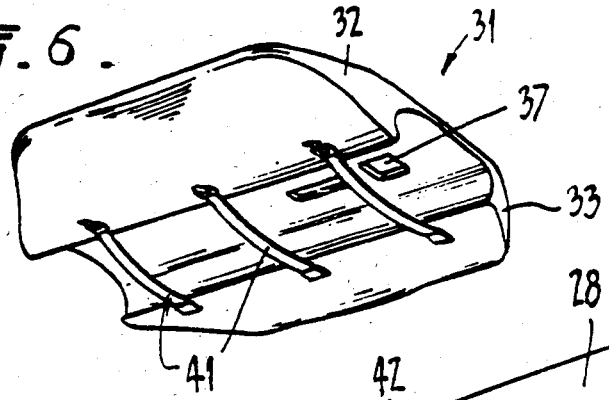
FIG. 7.
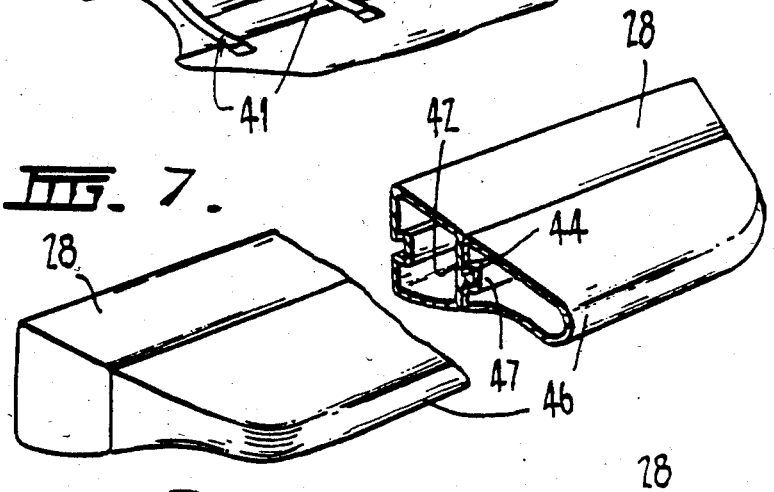
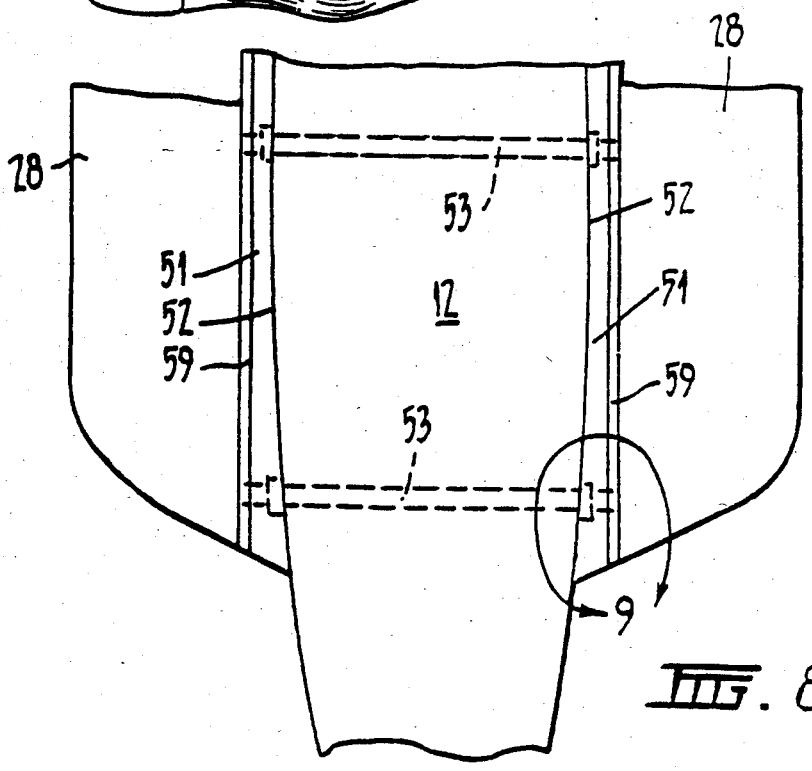
FIG. 8.

SAILBOARD WITH REMOVABLE FLOATS

BACKGROUND OF THE INVENTION

This invention relates to improvements in sailboards and relates particularly to improvements to enable learners to more easily master the art of sailboard riding and to enable sailboards to be varied to take account of varying water conditions.

Sailboards are inherently difficult to learn to ride and sail and learners may spend many hours mastering the arts of controlling and steering the sailboard. Sailboard simulators have been proposed to assist the learner but it has been found that once the learner ventures onto the water with a sailboard the lessons learnt on a land-based simulator are of little value.

Further, sailboard riders may develop the various skills required for riding a sailboard in relatively calm water to find great difficulty in riding the sailboard in rougher waters or in relatively strong winds which adversely affect the stability of the sailboard.

It has long been known to use one or more floats to give stability to marine craft. Australian Patent Application No. 62604/80 describes the use of a pair of floats to give added stability to a sailboard. In this specification, the floats are carried by support means and are releasably secured to the sailboard so that the floats act to effectively broaden the beam of the sailboard to provide more stability.

U.K. Patent Application No. 2,084,521 discloses a similar arrangement of floats or pontoons for providing added stability to a sailboard. In this specification, the pontoons are rigidly interconnected by a cross-member which is held to the sailboard by appropriate straps or the like.

The arrangements described in these two patent specifications do not fully overcome the difficulties experienced by learners in mastering the arts of sailing a sailboard. Such floats or pontoons are relatively heavy and complicated and require a special fastening means to enable the floats or pontoons to be secured to the sailboard. Further, the cross-members interconnecting the floats or pontoons constitutes an obstruction on the upper surface of the sailboard such that the sailboard rider must be constantly aware of and be careful with his/her foot placement to avoid tripping.

French Patent Application No. 7924371 (Publication No. 2466390) and the corresponding European Patent Application No. 80420107.7 disclose other arrangements of floats secured to the side edges of a sailboard in order to improve the stability of the board. The floats described in these specifications are secured by straps which pass over and under the sailboard and the floats are formed with fittings which, it is proposed, act to reduce relative pivotal movement between the float and the sailboard.

However, because of the inherent flexibility of the straps and the float material, some relative movement does occur between the sailboard and the floats. Further, the straps passing across the top of the sailboard provide an obstruction for the feet of the sailboard rider.

It is an object of the present invention to obviate the disadvantages inherent in the use of floats as described in the above referenced patent specifications.

It is also an object of the present invention to provide apparatus which can be used with a sailboard during initial learning and which can be removed therefrom once the learner has developed skills in the sailboard sailing art, said apparatus being relatively simply attached to the sailboard and easily removed therefrom.

SUMMARY OF THE INVENTION

The present invention, in its broadest form, comprises flotation means secured to a sailboard in such a manner as to effectively extend laterally the upper surface of the sailboard whilst providing additional stability therefor.

In one form, there is provided a sailboard stabilizer comprising a sleeve adapted to engage over the sailboard, said sleeve having upper and lower webs adapted to engage upper and lower surfaces of the sailboard and each web being secured to flotation means which form the side edges of the sleeve, said flotation means being shaped to engage opposite side edges of the sailboard, the upper web having a first aperture through which sailboard mast passes and a second aperture which is aligned with an aperture in the lower web and through which the sailboard daggerboard can pass.

In one form, the upper and lower webs are integral with the flotation means and are formed of a substantially rigid material such as fibreglass, synthetic plastic material such as polyethylene, or the like.

In another form, the upper and lower webs are integral with side edge portions which engage the side edges or rails of the sailboard. The flotation means are either releasably or permanently fixed to the side edge portions of the sleeve, the structure in assembled relationship, being relatively rigid and being adapted to engage on the sailboard to provide a relatively rigid platform.

The flotation means may comprise an outer casing of fiberglass, synthetic plastic material such as polyethylene, or the like and the interior of the float may remain hollow or may be filled with a foam plastic material such as foamed polyurethane or polystyrene.

The structure of the present invention acts to extend the width of the upper surface of the sailboard when engaged thereon and provides a substantially rigid, stable platform on which a learner is able to learn the skills associated with sailboard riding.

According to another aspect of the present invention the lower web of the "sleeve" may be replaced with one or more straps or other flexible releasable fastening means. With this arrangement, the upper web which is either integral with the flotation means or with side edge portions to which flotation means are attached, is able to be engaged with the upper surface of the sailboard and the flotation means and/or side edge portions rigidly secured to the side edges or rails of the sailboard by the straps or other flexible fastening means passing beneath the sailboard.

According to another aspect of the present invention there is provided a pair of elongated flotation means, each means of the pair having attachment means along one longitudinal edge thereof and the sailboard being provided with complementary attachment means for receiving and securing the attachment means on each flotation means to the sides of the board so that the flotation means effectively extend the width of the board at least along a central portion thereof.

In order that the invention will be more readily understood, several embodiments thereof will now be described with reference to the accompanying drawings.

BRIEF DESCRIPTION OF THE DRAWINGS

FIG. 6 is an underneath perspective view showing a modification of the embodiment illustrated in FIG. 5;

FIG. 7 is a perspective view showing a modified form of the embodiment of FIG. 1;

FIG. 8 is a plan view of a further form of the invention;

DESCRIPTION OF PREFERRED EMBODIMENTS

Figure 1:
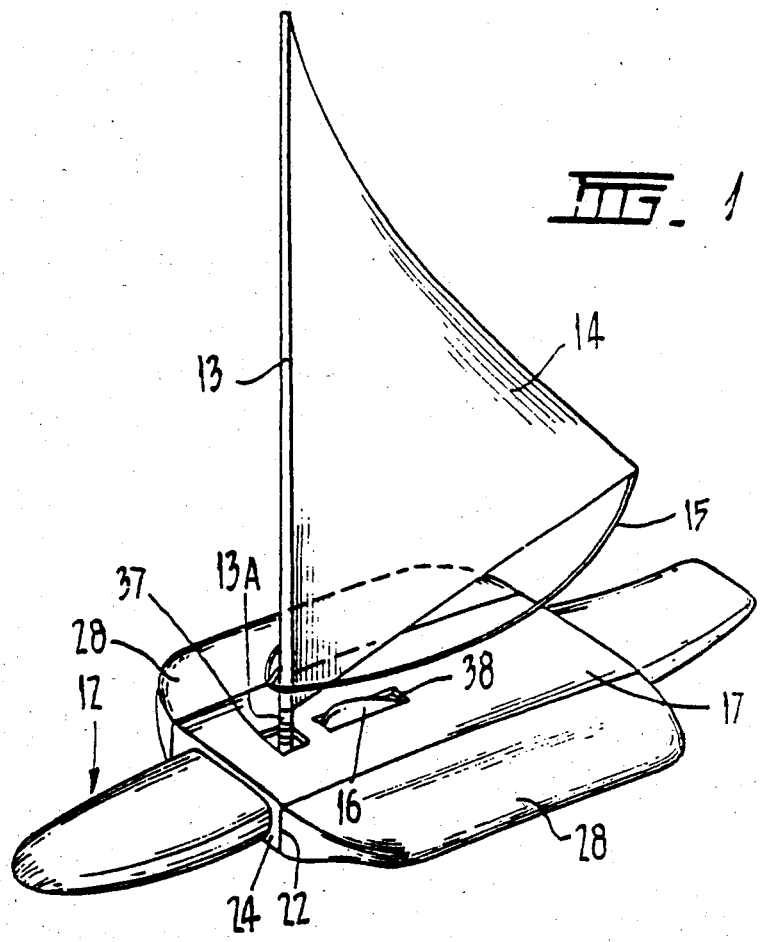
FIG. 1 is a perspective view of a sailboard having a stabilizer in accordance with one embodiment of the invention.
Figure 2:
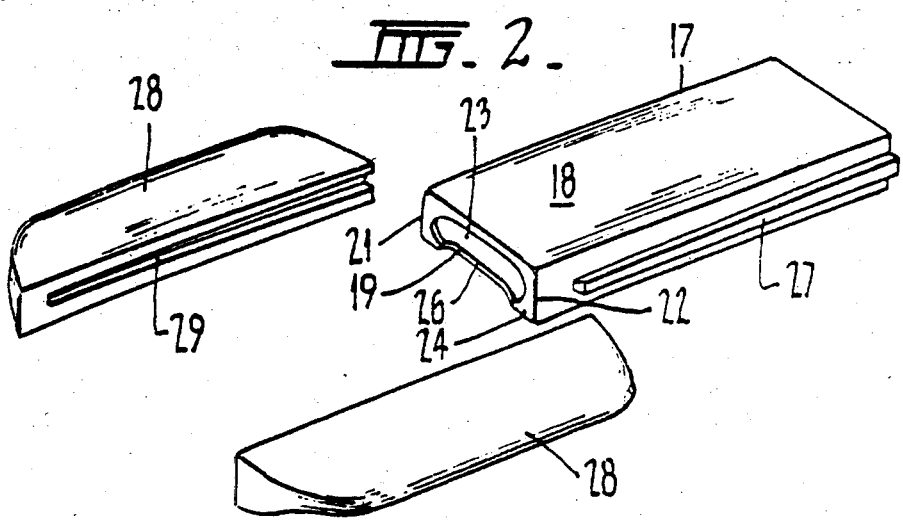
FIG. 2 is an exploded perspective view of the stabilizer of FIG. 1.
Figure 3:
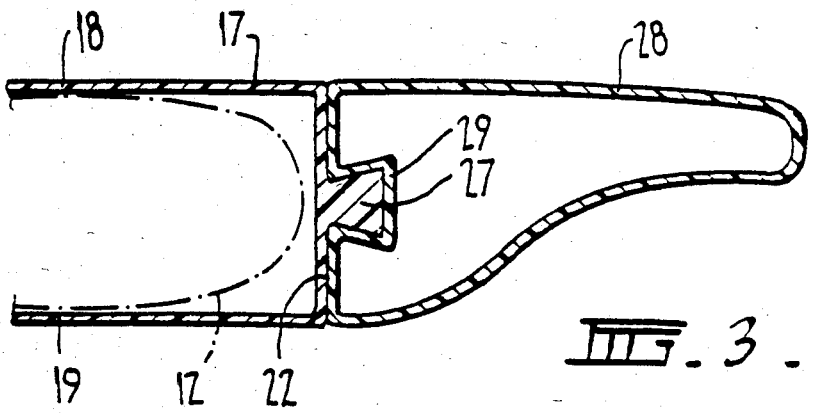
FIG. 3 is a cross-sectional detail view showing the interconnection between the sleeve and float of the stabilizer of FIG. 1.
Figure 4:
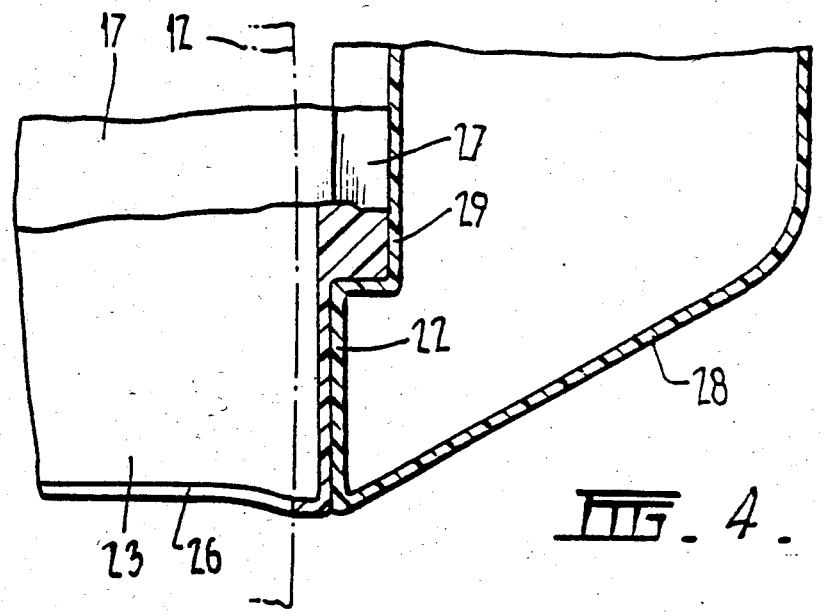
FIG. 4 is a part sectional plan view showing the interconnection between the sleeve and the float.
Figure 5:
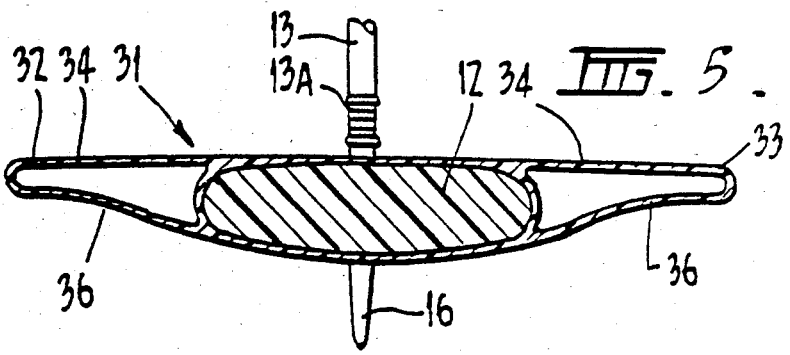
FIG. 5 is a cross-sectional elevational view of a second form of the invention in place on a sailboard.

Referring to the drawings, there is illustrated in FIG. 1 a sailboard 12 having a mast 13, a sail 14, a wish-bone shaped boom 15 and removable daggerboard 16. As is known in the art, the mast is secured to the sailboard through a flexible or universal joint 13*a* which enables the mast to move in any direction relative to the sailboard.

In the embodiment illustrated in FIGS. 1 to 4, the stabilizer of the present invention comprises a sleeve 17 formed of upper and lower webs 18 and 19, respectively, the webs being integral with substantially parallel side edge portions 21 and 22. The sleeve 17 is preferably formed of fibreglass or synthetic plastic materials such as polyethylene.

The opening 23 at the front of the sleeve 17 is formed in the sleeve front wall 24 to be of a shape and dimensions to closely fit the sailboard when in position. The edge 26 of the lower web 19 is tapered to provide minimum water resistance during use.

Each of the side edge portions 21 and 22 is formed with an outwardly extending, undercut projection 27 extending longitudinally along the respective side edge portion from a rear wall of the sleeve but terminating short of the front wall 24 of the sleeve 17.

A pair of flotation members 28, which may either be hollow or filled with foamed synthetic plastic material, such as polyurethane, polystyrene or the like, and which may be made of fibreglass, polyethylene or other synthetic plastic material, are provided along side edges with an elongated, groove-like receptor 29 having a shape corresponding to the shape of the projection 27. The flotation members 28 are of relatively rigid construction and engage with the sleeve 17 by a longitudinal engaging movement so that the front and rear walls of the flotation members 28 are substantially aligned with the front and rear walls of the sleeve 17. The flotation members 28 may be fixed to the stabilizer through which the sailboard passes and is shaped longitudinally so as to take advantage of the tapering shape of the sailboard whereby the stabilizer 31 engages the side rails at and forwardly of the widest part of the sailboard to positively locate the stabilizer longitudinally thereon. Because of the inward taper rearwardly of the widest part of the sailboard, a small clearance exists between the inner surface of the stabilizer 31 and the sailboard side rails rearwardly of the widest part, which clearance assists in mounting and demounting the sleeve on the sailboard. If desired, rubber wedges or the like may be fitted into the clearance on each side to prevent relative movement during use.

As shown in FIG. 1, additional location means is also provided by an aperture 37 in the upper web through which the mast 13 is engaged with the sailboard 12 and the further aperture 38 in the upper web and a corresponding aperture in the lower web through which the daggerboard 16 is engaged with the sailboard 12. It will be appreciated that such apertures are provided in the upper and lower webs of both the embodiments illustrated in FIGS. 1 to 4 and FIG. 5.

The embodiment illustrated in FIG. 6 is similar to that of the previous embodiments except that the lower web is replaced by flexible straps or other releasable fasteners 41 which engage with lower surfaces of the flotation members 28 or with the side edge portions of the sleeve 17, the straps 41 being able to be fastened to secure the flotation members 28 and the upper web to the sailboard 12. With this arrangement, the upper surface of the stabilizer remains relatively rigid to provide an extended platform on which the sailboard rider may stand and yet facilitates the mounting of the stabilizer on the sailboard 12.

The embodiment of FIG. 7 may be constructed in a manner similar to any of the previous embodiments with the modification of the outer edge portion 42 of the flotation member 28 being formed with a longitudinally extending, undercut rib or projection 44 to enable second flotation member 46 to be engaged therewith, said second flotation member 46 having a groove or similar formation 47 to receive the undercut rib or projection 44. With this arrangement, the width of the platform provided by the stabilizer can be varied, as desired, by adding additional flotation members, as necessary. Thus, a beginner may commence with a platform of maximum width and after mastering some of the skills of sailboard riding, the outer flotation members 46 may be removed leaving the relatively smaller, inner flotation members 28 to provide minimal additional stability and support. Preferably, the rib or projection 44 and the cooperating groove 47 are of a dovetail or wedge shape.

Figure 9:
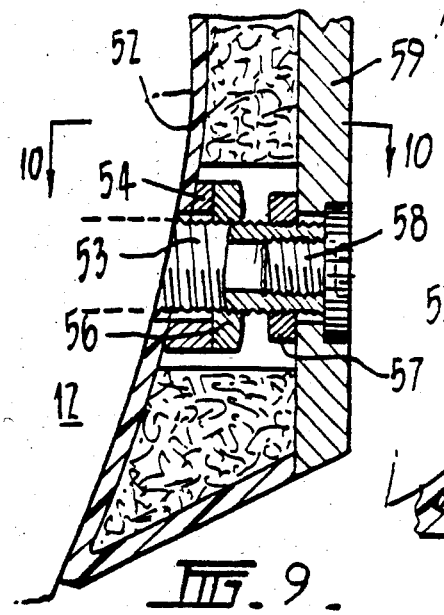
FIG. 9 is a detail plan view of the embodiment of FIG. 8.
Figure 10:
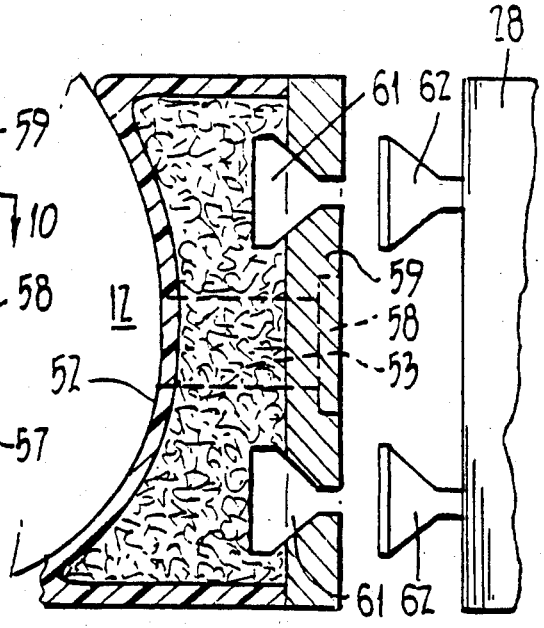
FIG. 10 is a detail cross-section taken along the lines 10—10 of FIG. 9.

Referring to FIGS. 8 to 10 of the drawings, a pair of substantially rigid flotation members 28 are releasably mounted on support members 51 secured to the side rails 52 of the sailboard 12. The support members 51 are substantially straight and parallel to each other and are supported on the side rails 52 of the sailboard by four transversely extending tubes 53 which are located within transversely extending openings passing through the sailboard 12. As shown particularly in FIG. 9, the tubes 53 have internally and externally threaded ends which extend beyond the side rails 52 and a packing piece 54 is engaged with each end of each tube 53 and is secured against the respective side rail 52 by a threaded nut 56.

The support members 51 each engage over the ends of the tubes 53 and are supported in position against a second nut 57 which is spaced along the length of the projecting portion of the tube 53 in order that the support members 51 are maintained substantially straight and parallel. A plug 58 secures the support members 51 against the second nut 57 thus firmly holding the support members 51 in position along the side rails 52.

Each support member 51 is provided with a rigid longitudinally extending side section 59 and the space between the side section 59 and the side rail 52 may be filled with a shaped, rubber infill, foamed plastic or other suitable material providing a smooth transition between the upper and lower surfaces of the sailboard 12 and the upper and lower surfaces of the flotation members 28 mounted on the support members 51.

The support members 51 are provided with longitudinally extending dovetail or wedge-shaped grooves 61 along the side sections 59. The grooves are adapted to receive complimentary projections 62 extending from the longitudinal side edge of the flotation members 28 whereby the interengaged projections 62 and grooves 61 securely and rigidly support the flotation members 28.

Although the flotation members 28 are illustrated as one piece units, it will be appreciated that two piece flotation members similar to that shown in FIG. 7 may be utilized in this embodiment of the invention.

If desired, appropriate clips or fastening means may be provided to prevent undesired longitudinal sliding between the flotation members 28 and the support members 51. Otherwise, the shape and dimensions of the grooves 61 and projections 62 may be such as to facilitate relatively smooth, longitudinal sliding interengagement of the parts.

Figure 11:
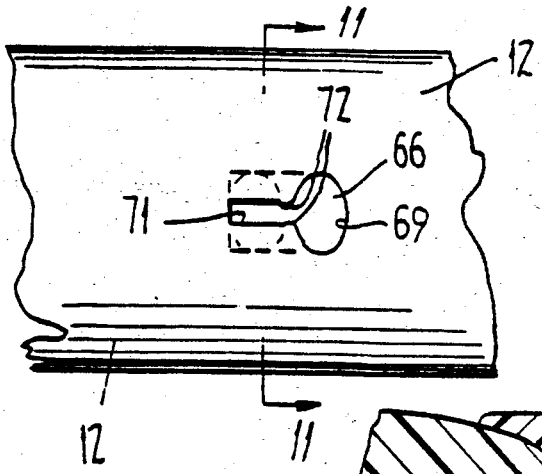
FIG. 11 is a side elevational detail view of a further fastening arrangement in accordance with the present invention.
Figure 12:
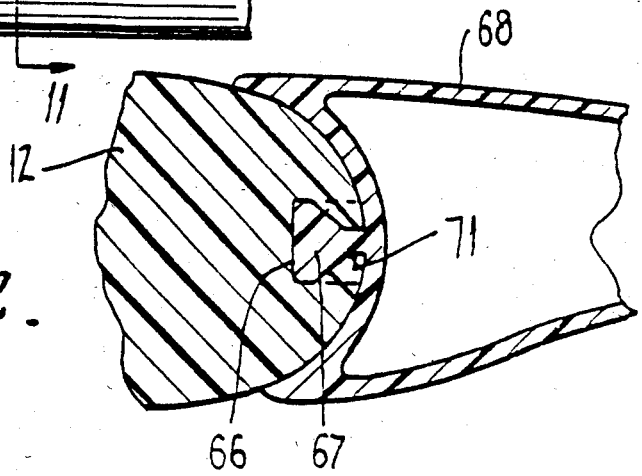
FIG. 12 is a detail cross-sectional view taken along the lines 12—12 of FIG. 11.

Referring to FIGS. 11 and 12, a further embodiment of the invention involves the manufacture of the sailboard 12 with a plurality of keyhole-shaped openings 66 in the side rails 52 of the sailboard 12. The keyhole openings 66, of which there may be two, three, four or more along each side rail 52, are spaced therealong and are adapted to receive undercut projections 67 formed in the longitudinal side edge of flotation members 68 which are otherwise formed in a manner similar to that of the flotation members 28 of the previous embodiments. The projections 67 engage through the large opening 69 in the keyhole opening 66 and the flotation members 68 are then moved longitudinally relative to the sailboard 12 so that the projections 67 engage behind the narrow portion 71 of the keyboard opening 66. One or more ridges 72 may be provided on the edges of the narrow portion 71 to restrict undesired longitudinal relative movement between the flotation members 68 and the sailboard 12 which would otherwise give rise to disengagement.

The flotation members 68 have their longitudinal edge portions shaped to correspond with the side rail shape of the sailboard 12 to which the flotation members 68 are to be attached. Preferably, upper and lower tapered edge portions 73 are provided on the flotation member 68 to assist in the smooth transition between the surface of the sailboard 12 and the surfaces of the flotation members 68.

In all the described embodiments, the upper surface of the flotation members 28 is preferably roughened or textured to provide a secure footing for a person riding the sailboard. The shape of the front and rear ends of the flotation members may be tapered to facilitate movement of the flotation members through the water, in use, which also adds to the stability of the sailboard.

It has been found that the present invention provides enough additional flotation and stability that a sailboard to which the flotation members of the invention are attached is able to support two adults thus enabling an instructor and a learner to ride the sailboard together. Once the learner has mastered the skills with the flotation members of the invention in place, the flotation members are simply removed from the sailboard and the learner is able to practice on the sailboard without the additional support surface provided by the flotation members of the invention.

The flotation members, sleeves and other parts forming the structure of the invention may be molded by rotational molding techniques known in the art or by injection moulding or fabricating processes.

I claim:

1. An accessory for a sailboard comprising a pair of relatively rigid elongated flotation members formed of synthetic plastic material, each flotation member having an inner side and a substantially flat upper surface extending from the inner side to an outer side, a sleeve to engage on the sailboard, the sleeve having opposed side edge portions and an upper web extending between the side edge portions, the side edge portions and web having a length substantially equal to the length of the inner sides of the flotation members and the side edge portions being shaped to engage side rails of the sailboard with the web closely engaging and overlying an upper surface of the sailboard, means to interconnect the side edge portions and extend across a lower surface of the sailboard to releasably secure the sleeve thereto, means to rigidly secure the side edge portions of the sleeve to respect flotation members, and the upper surfaces of the flotation members being substantially coextensive with the upper web so that, in use, the upper surface of the railboard extends across the flotation members and the flotation members and sleeve form a substantially rigid unitary structure with the sailboard with the side edge portions of the sleeve engaged with the sailboard side rails.

2. An accessory according to claim 1 wherein each said flotation member is formed of two separate float sections having interengaging longitudinal side edges whereby the separate float sections are releasably secured to each other.

3. An accessory according to claim 2 wherein front edge portions of said flotation members slope downwardly and rearwardly to assist movement through water.

4. An accessory according to claim 1 wherein said flotation members are hollow.

5. An accessory for attachment to a sailboard comprising:

(a) a pair of relatively rigid flotation members, each member having a substantially flat upper surface;

(b) attachment means on an inner, longitudinal side of each flotation member;

(c) mounting means interconnecting the attachment means of each flotation member and the defining an opening to closely receive the sailboard, said mounting means having;

(d) upper and lower web means extending longitudinally and transversely about the upper and lower surfaces of said sailboard thereby encompassing said sailboard between opposed side rails thereof;

the upper web means being substantially coplanar with the flat upper surfaces of the flotation members and having a longitudinal dimension substantially equal to the length of the said inner side of each flotation member, and being continuous at least along that part of the upper web means adjacent each flotation member, the transverse dimension of the upper and lower web means being such that the flotation members are rigidly mounted to the opposed sailboard side rails to form a substantially unitary relatively rigid structure with the flat upper surfaces of the flotation members being substantially coextensive with the upper surface of the sailboard to thereby effectively extend the sailboard upper surface area.

6. An accessory according to claim 5, wherein:

(a) said flotation members are irremovably fixed to said mounted means by adhesive or welding.

7. An accessory according to claim 5 wherein:

(a) said mounting means comprises a sleeve having a front wall and a rear wall with apertures therein corresponding to the cross-sectional shape of the sailboard to which the sleeve is to be fitted, the edges of said aperture and the front wall closely engaging the sailboard at a location along its length corresponding to the desired position of the sleeve on the sailboard, the cross-sectional area at such location being less than the greatest cross-sectional area of the sailboard.

8. An accessory according to claim 5, wherein said mounting means includes a lower web integral with said flotation member, said upper and lower web having a longitudinal dimension substantially equal to the length of said flotation members.

9. An accessory for a sailboard comprising a pair of relatively rigid flotation members, each flotation member having a substantially flat upper surface extending from one side toward an outer side, attachment means along said one side of each flotation member, a sleeve releasably attached by the attachment means to the flotation members, the sleeve releasably engaging with the sailboard with upper and lower webs of the sleeve and overlying contact engagement with respective upper and lower surfaces of the sailboard, the upper and lower web having a longitudinal dimension substantially equal to the length of the flotation members and having integral opposed side portions to rigidly mount each flotation member in a predetermined position relative to a respective side edge portion of the sailboard, the flotation members and sleeve forming with the sailboard a substantially unitary relatively rigid structure having a substantially coextensive upper surface formed of the said upper surfaces of the flotation members and the upper surface of the sailboard, and said attachment means comprises at least one longitudinally extending undercut projection on the flotation members and the opposed side portions of the sleeve are formed with complementary grooves whereby the flotation members are engaged with the sleeve by relative longitudinal sliding engagement of the projection within the groove.

10. An accessory according to claim 9 wherein said projection on said flotation members extends from one end thereof to terminate at a position spaced from the other end thereof, said projection having a width which tapers inwardly from said one end.

11. An accessory according to claim 9, wherein said flotation members are irremovably fixed to said sleeve by adhesive or welding.

12. An accessory according to claim 9, wherein said sleeve has a front wall and a rear wall with apertures therein corresponding to the cross-sectional shape of the sailboard which the sleeve is to be fitted, the edges of said aperture in the front wall closely engaging the sailboard at a location along its length corresponding to the desired position of the sleeve on the sailboard, the cross-sectional area at such location being less than the greatest cross-sectional area of the sailboard.

13. An accessory for attachments to a sailboard, comprising:

(a) a pair of relatively rigid flotation members, each member having a substantiall flat upper surface, (b) mounting means on one side of each flotation members to rigidly and releasably mount the flotation members to the sailboard, said mounting means having;

(c) support members fixed along each side edge portion of said sailboard by connectors passing through the sailboard, said support members having outer side surfaces which are substantially parallel and are provided with longitudinally extending projection or groove means which cooperate with corresponding means on the said one side of the respective flotation members such that the flotation members are rigidly mounted to the opposed sailboard side rails to form a substantially unitary relatively rigid structure with the flat upper surfaces of the flotation members being substantially coextensive with the upper surface of the sailboard to thereby effectively extend the sailboard upper surface area.

14. An accessory according to claim 13 wherein said support members comprise relatively rigid elongated sections fixed to transversely extending tubes passing through said sailboard.

15. An accessory for attachment to a sailboard comprising:

(a) a pair of relatively rigid flotation members, each member having a substantially flat upper surface;

(b) mounted means on one side of each flotation member to rigidly and releasably mount the flotation members to the sailboard, said mounting means having a plurality of individual, undercut projections extending from inner side surfaces of each flotation member and wherein the side edge portions of said sailboard are formed with a corresponding number of recesses having keyhole-shaped access openings whereby said projections are received into said recesses and locked therein by relative longitudinal movements such that the flotation members are rigidly mounted to the opposed sailboard side rails to form a substantially unitary relatively rigid structure with the flat upper surfaces of the flotation members being substantially coextensive with the upper surface of the sailboard to thereby effectively extend the sailboard upper surface area.

* * * * *